United States Patent [19]

Takahashi et al.

[11] Patent Number: 4,850,534

[45] Date of Patent: Jul. 25, 1989

[54] ULTRASONIC WAVE NEBULIZER

[75] Inventors: Minoru Takahashi, Funabashi; Kiyoto Sudou, Shiojiri; Hiromitsu Hirayama, Funabashi, all of Japan

[73] Assignee: TDK Corporation, Tokyo, Japan

[21] Appl. No.: 183,679

[22] Filed: Apr. 19, 1988

[30] Foreign Application Priority Data

| | | | |
|---|---|---|---|
| May 30, 1987 | [JP] | Japan | 62-85232[U] |
| Jun. 16, 1987 | [JP] | Japan | 62-92169[U] |
| Aug. 13, 1987 | [JP] | Japan | 62-123202[U] |
| Dec. 2, 1987 | [JP] | Japan | 62-183834[U] |
| Dec. 12, 1987 | [JP] | Japan | 62-314928 |
| Dec. 21, 1987 | [JP] | Japan | 62-192843[U] |

[51] Int. Cl.[4] ..... B05B 3/14

[52] U.S. Cl. ..... 239/102.2; 239/397; 239/512; 310/325; 310/340

[58] Field of Search ..... 239/102.1, 102.2, 512, 239/4, 397; 310/325, 321, 323, 340; 417/211, 240, 241, 322, 417

[56] References Cited

U.S. PATENT DOCUMENTS

| | | | |
|---|---|---|---|
| 57,271 | 8/1866 | Adams | 239/DIG. 19 |
| 2,701,165 | 2/1955 | Bete et al. | 239/512 |
| 3,103,310 | 9/1963 | Lang | 239/102.2 |
| 3,145,931 | 8/1964 | Cleall | 239/4 |
| 3,202,962 | 8/1965 | Elston | 310/340 |
| 3,690,317 | 9/1972 | Millman | 239/102.1 |
| 4,165,961 | 8/1979 | Yamamoto et al. | 239/102.2 |
| 4,193,009 | 3/1980 | Durley, III | 310/325 |
| 4,319,716 | 3/1982 | Lauer | 239/102.2 |
| 4,406,587 | 9/1983 | Perry | 417/211 |
| 4,416,589 | 11/1983 | Perry | 417/211 |
| 4,488,854 | 12/1984 | Miller | 417/241 |
| 4,496,101 | 1/1985 | Northman | 239/102.2 |
| 4,541,564 | 9/1985 | Berger et al. | 239/102.2 |
| 4,607,185 | 8/1986 | Elbert et al. | 310/323 |
| 4,619,400 | 10/1986 | Van der Burgt | 239/102.1 |
| 4,655,393 | 4/1987 | Berger | 239/102.1 |
| 4,723,708 | 2/1988 | Berger et al. | 239/102.2 |

FOREIGN PATENT DOCUMENTS

| | | | |
|---|---|---|---|
| 808708 | 3/1981 | U.S.S.R. | 417/241 |

*Primary Examiner*—Andres Kashnkow
*Assistant Examiner*—Christopher G. Trainor
*Attorney, Agent, or Firm*—Burgess, Ryan & Wayne

[57] ABSTRACT

A nebulizer which pumps up water and mists the pumped up water comprises an elongated main body with a center hole for water passage, and piezoelectric vibration elements together with electrodes for energizing the same mounted on the main body. The vibration elements are water-proofed, and the nebulizer itself is supported by using a flange on a water-proof member and the flange is on a plane on which a center electrode is positioned. Upon vibration of the elements, water is pumped up through the inlet of the main body, and is dissipated into the air through the outlet of the main body. Preferably, the inlet and the outlet are removable from the main body, and the inlet is coated with a thin hard film. Preferably, the outlet is covered with a mesh, or at least an opening of the outlet is covered for preventing the release of water that has not been converted to mist.

12 Claims, 11 Drawing Sheets

ULTRASONIC WAVE NEBULIZER

BACKGROUND OF THE INVENTION

The present invention relates to an ultrasonic wave pump, or an ultrasonic wave nebulizer for converting liquid water to mist, in which an ultrasonic wave vibration by a piezoelectric vibrator element operates as both a pump for the suction of water, and for nebulizing water.

We have proposed an ultrasonic humidifier for converting water to mist. U.S. Pat. No. 4.338 576 is one of the examples. In the prior humidifier, an ultrasonic vibrator made of piezoelectric ceramics is bottom mounted and partially submerged in water which is atomized upon vibration of the ceramics, and an electric fan blows creating mist. Therefore, it must have not only an ultrasonic vibrator, but also a fan which has a mechanical rotation member. Further, a tank for mounting water must have the particular structure for securing an ultrasonic vibrator.

Another structure for an ultrasonic pump is proposed in the Japanese patent application No. 309113/86 by our company, as indicated in FIG. 1.

In FIG. 1, the numeral 1 is an elongated main body having a first horn 4 for amplifying vibration, and a circular inlet 5 at the bottom of the body . The body 1 has also a second horn 30 for amplifying vibration, and a circular outlet 31 at the top of the body 1. The horn portions 4 and 30 are thinner than other portions of the main body so that the vibration in the main body is amplified in the thinner portion. The middle portion of the body 1 has male screw portions 2 and 3. The body 1 has also an elongated through hole 6 at the center of the main body 1, allowing for the passage of water. The bottom opening of the through hole 6 is at the center of the circular inlet 5, and the top opening of the through hole 6 is at the center of the circular outlet 31.

A circular flange 8, a circular first electrode 9A, a circular first piezoelectric vibrator 10A, a circular second electrode 9B, a circular second piezoelectric vibrator 10B, a circular third electrode 9C, a washer 12, and a plate spring 13 are penetrated by the main body 1, and those penetrated members are fixed to the main body 1 by a pair of nuts 11A and 11B which engage with the male screw portions of the main body 1.

When the water surface P is in the range Q, and the bottom inlet 5 is in the water, the vibrators 10A and 10B vibrate (thickness vibration) by applying high frequency voltage across the electrode 9B and the electrodes 9A and 9C. The vibration is amplified at the horn 4 which is thinner than the middle portion, and then, the ultrasonic vibration in the direction indicated by the arrow R is provided at the inlet 5.

Then, water is pumped up along the arrow S into the through hole 6. The water thus raised reaches the top of the main body 1, and vibrates violently at the top surface of the outlet 31, then, the water at the top surface of the outlet 31 is converted to mist which dissipates in the air.

The structure of FIG. 1 was intended to be used in an air-conditioner for nebulizing drain water into the air.

However, we realized the disadvantages of the structure of FIG. 1 in our research test as follows.

First, when the structure is supported by using the flange 8 which is located under the vibrators, the flange 8 itself vibrates, therefore, the vibration is not sufficiently sent through the water.

Secondly, since the structure is not water-proof, when there is an overabundance of water, the vibrators 10A and 10B are dipped in water. Additionally, the mist is then converted again to water, which flows downwardly to wet the vibrators 10A and 10B.

Another disadvantage is the diameter of the inlet 5 and the outlet 31. For manufacturing reasons, it is preferable that the diameter of the inlet and the outlet are equal to or less than the diameter of the middle portion of the main body, since the nuts 11A and 11B must pass the inlet and the outlet when the structure is assembled. On the other hand, for operational reasons, it is preferable that the diameter of the inlet and the outlet be larger than the diameter of the middle portion of the main body so that the nebulizing operation is carried out efficiently. Since a prior structure has an integrated structure, it was impossible to meet with these two requirements.

SUMMARY OF THE INVENTION

It is an object, therefore, of the present invention to overcome the disadvantages and limitations of a prior ultrasonic nebulizer.

It is also an object of the present invention to provide an ultrasonic nebulizer which is supported without disturbing the operation of the vibrators, which are secured and water-proof.

It is still another object of the present invention to provide a nebulizer in which an inlet and an outlet may have a larger diameter than of a main body itself.

The above and other objects are attained by a nebulizer having an elongated main body having a center through hole, a water inlet at one end and a mist outlet at the other end, said main body having male screw at external wall around the central portion of the main body, a plurality of disc shaped vibration elements together with electrodes for energizing the same, each having center hole for accepting said main body, a pair of nuts for fixing said vibration elements together with electrodes on said main body by engaging with male screw on said main body so that the vibration elements are symmetrical to a plane which is perpendicular to an axis direction of said main body, a first water proof means covering said vibration elements and said electrodes, having a flange for fixing the nebulizer to an external structure, a second water proof means for preventing water to said vibration elements through a path between said nuts and said main body.

BRIEF DESCRIPTION OF THE DRAWINGS

The foregoing and other objects, features, and attendant advantages of the present invention will be understood by means of the following description and the accompanying drawings wherein.

DESCRIPTION OF THE PREFERRED EMBODIMENTS

Figure 1:
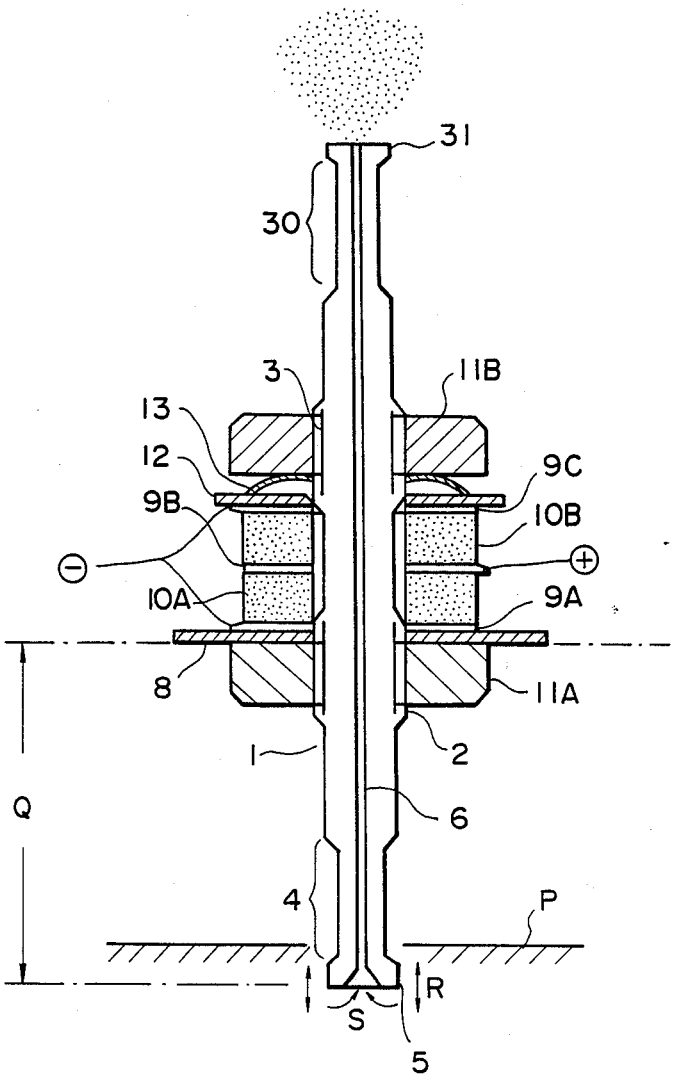
FIG. 1 PRIOR ART
FIG. 1 shows a structure of a prior nebulizer.
Figure 2:
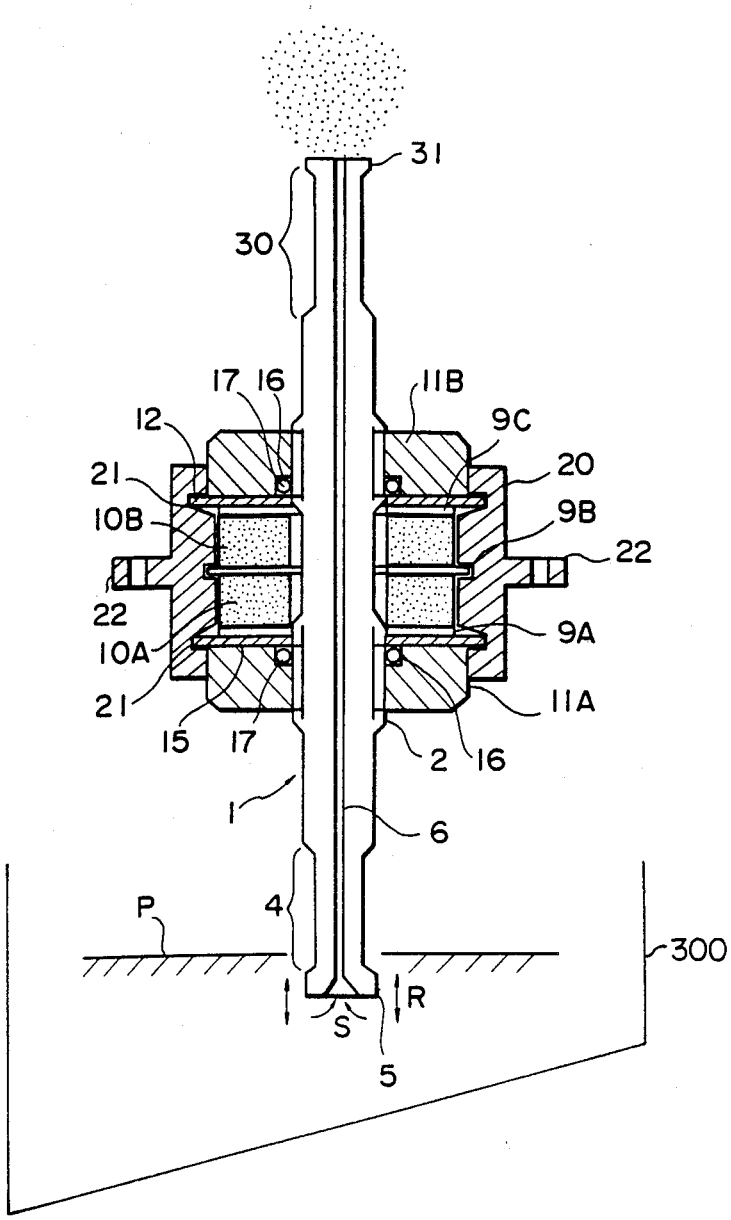
FIG. 2 shows structure of the first embodiment of the nebulizer according to the present invention.

FIG. 2 shows the embodiment of the present invention. In the figure, the main portion of a pump itself is essentially the same as that of FIG. 1, but a circular plane washer 12 is used, instead of a circular flange 12 of FIG. 1, and no plate is spring is used in FIG. 2. In FIG. 2, the main body 1 is inserted into the center holes of the circular plane washer 15, the circular electrode 9A, the circular piezoelectric vibration element 10A, the circular electrode 9B, a circular piezoelectric vibration element 10B, a circular electrode 9C, and a circular plane washer 12. Those members are fixed by a pair of nuts, 11A and 11B, which engage with the male screw portions 2 and 3 on the main body 1.

Each of the nuts 11A and lB has a ring shaped groove 16 around the female screw of the same, and an O-ring 17 is secured in said groove 16. Therefore, the O-ring 17 is positioned between the nut 11A (or 11B), and the main body 1 so that water-proofing is provided.

Further, a dielectric resilient cover 20 which is made of gum surrounds the members between the nuts 11A and 11B so that the piezoelectric vibration elements are water-proofed. The water-proof cover 20 has a pair of grooves 21 which engage with the circular plane washers 12 and 15, inside of the same. Further, the water-proof cover 20 has a ring shaped flange 22 on the external wall of the same, so that the pump itself is fixed to an external structure by using said flange 22. It should be noted that the water-proof cover 20 is resilient, and fixed to the nuts 11A and 11B, and the washers 12 and 15 resiliently, therefore, the members inside of the cover 20 are water-proof.

The structure of the main body 1 is essentially the same as that of FIG. 1.

According to the embodiment of FIG. 2, the water-proof cover 20 provides water-proofing of the piezoelectric vibration elements 10A and 10B, and further, a pair of 0-rings 17 provide water-proofing for the inside of the vibration elements 10A and 10B. Therefore, the vibration elements are completely water-proofed. Further, since the pump itself is fixed by using the flange 22 on the cover 20, the vibration is not disturbed. It should be noted that the flange 22 for fixing the pump is on the plane of the center electrode 9B which is located at the center of the vibration elements in along the axis of the main body, but the flange 22 does not contact the electrode 9B, nor the vibration elements 10A and 10B. Therefore, the vibration is not disturbed by the flange 22, and not attenuated.

Preferably, the frequency of the vibration is in the range between 10 kHz and 100 kHz, and optimumly, it is at 35 kHz.

Figure 3:
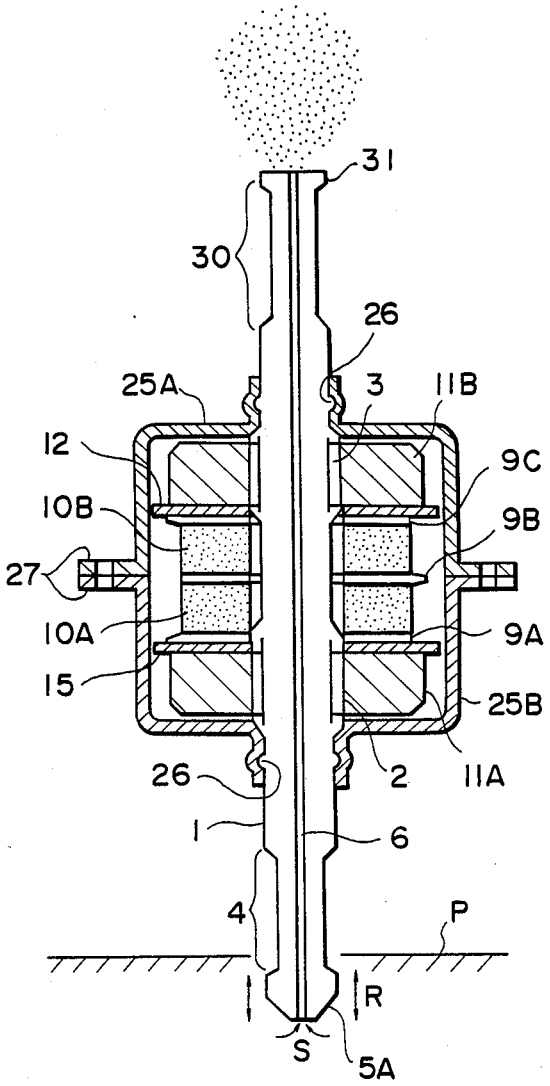
FIG. 3 shows another structure of the embodiment of a nebulizer according to the present invention.

FIG. 3 shows another embodiment of the present invention. The feature of the embodiment of FIG. 3 is the use of a pair of dielectric resilient half housings 25A and 25B which are made of plastics. Those half housings secure the piezoelectric vibration elements 10A and 10B, the electrodes 9A, 9B and 9C, the plane washers 12 and 15, and the nuts 11A and 11B. The main body 1 is provided with ring shaped projections 26 for the purpose of water-proofing so that the cylindrical hose of the half housing engages with said ring shaped projections. The half housing 25A and 25B has a flange 27 at which those half housings are coupled together. It should be appreciated that the flange 27 is on the plane of the center electrode 9B, and the pump itself is fixed by using said flange 27 which has holes for securing bolts for fixing the pump. The other structure of FIG. 3 is essentially the same as that of FIG. 2.

According to the embodiment of FIG. 3, the outside of the piezoelectric vibration elements are completely covered by the half housings, and therefore, the vibration elements are water-proofed. Further, due to the presence of the ring shaped projections 26 which are covered with the hose of the half housing, the vibration elements are water-proofed from leakage through the surface of the main body 1.

Figure 4:
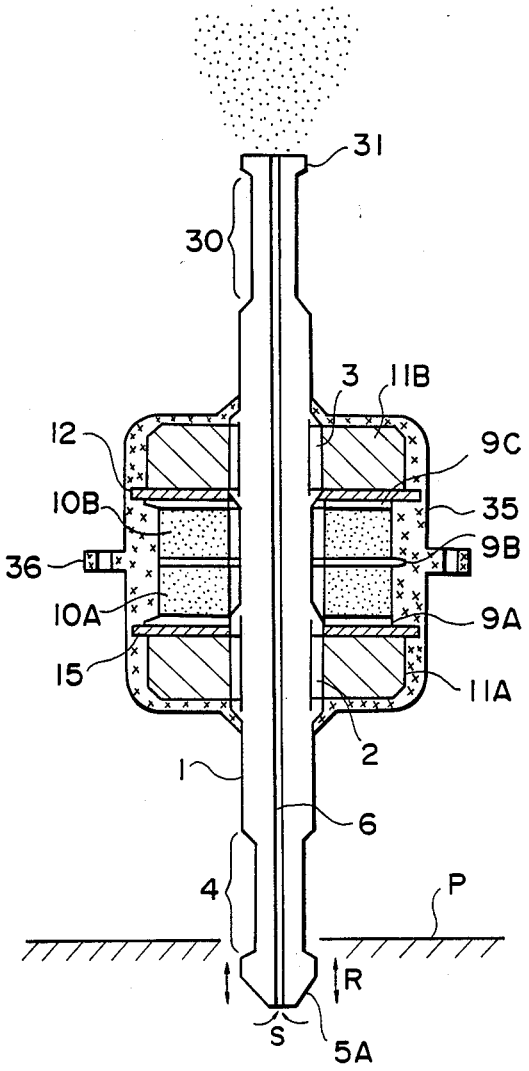
FIG. 4 shows still another structure of the embodiment of a nebulizer according to the present invention.

FIG. 4 is still another embodiment of the present invention. The feature of the embodiment of FIG. 4 is that the piezoelectric vibration elements 10A and 10B, together with the electrodes 9A, 9B and 9C, the washers 12 and 15, and the nuts 11A and 11B are molded by the dielectric resilient plastics 35, by using, for instance, an insert mold method. The mold cover 35 which has the flange 36 on the plane of the center electrode 9B functions similar to the cover of FIGS. 2 and 3 to provide water-proofing. It should be noted that the mold cover 35 in FIG. 4 is resilient, and it prevents little vibration of the vibration elements 10A and 10B.

In the above embodiments, an alternating voltage is applied between the electrode 9B, and the electrodes 9A and 9C. Then, the vibration elements 10A and 10B vibrate with the vibration propagating both downwards and upwards along the main body 1. The amplitude of the vibration is amplified at the portions 4 and 30, where the diameter of the main body 1 is thinner than other portions, since the amplitude is proportional to the inverse of the cross section. The vibration at the bottom of the main body in water effects to pump up water and to convert water to mist, which is dissipated into the air.

Since the vibration elements are covered with water-proof covers (20, 25A, 25B,35), the outside of the vibration elements does not get wet. Further, since the main body is provided with the water-proof member, (O-ring 17 in FIG. 2, ring shaped projection in FIG. 3, and molded plastics in FIG. 4), the inside of the main body also does not get wet.

Further, the structure is fixed to an external structure by using a flange which is on the plane of the center electrode which does not vibrate, the vibration is not disturbed nor attenuated, as a result of fixing the structure to the flange.

Next, the modification of the present invention is described in accordance with FIGS. 5 through 9. The feature of the modification is the use of a removable inlet cap and a removable outlet cap located at the bottom inlet of the main body, and the top of the main body, respectively.

Figure 6:
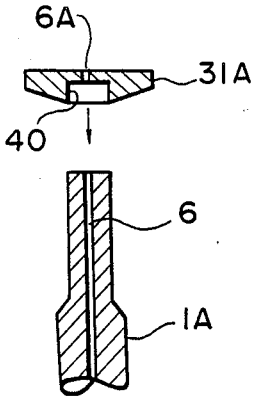
FIG. 6 shows the structure of the top portion of a main body 1 in FIG. 5.

The outlet cap 31A is essentially circular cylindrical, having a recess for accepting the top of the main body, and the hole 6A at the center of the cap 31A so that the hole 6A is positioned at the extension of the hole 6 of the main body 1A. The diameter $D_2$ of the top cap 31A is larger than the diameter $D_2$ of the main body 1A. FIG. 6 shows the detailed structure of the top cap 31A. Preferably, the top cap 31A is removably mounted at the top of the main body 1A. For instance, a female screw is provided at the inside wall of the recess of the top cap 31A, so that said female screw engages with the corresponding male screw on the top end of the main body 1A.

Figure 5:
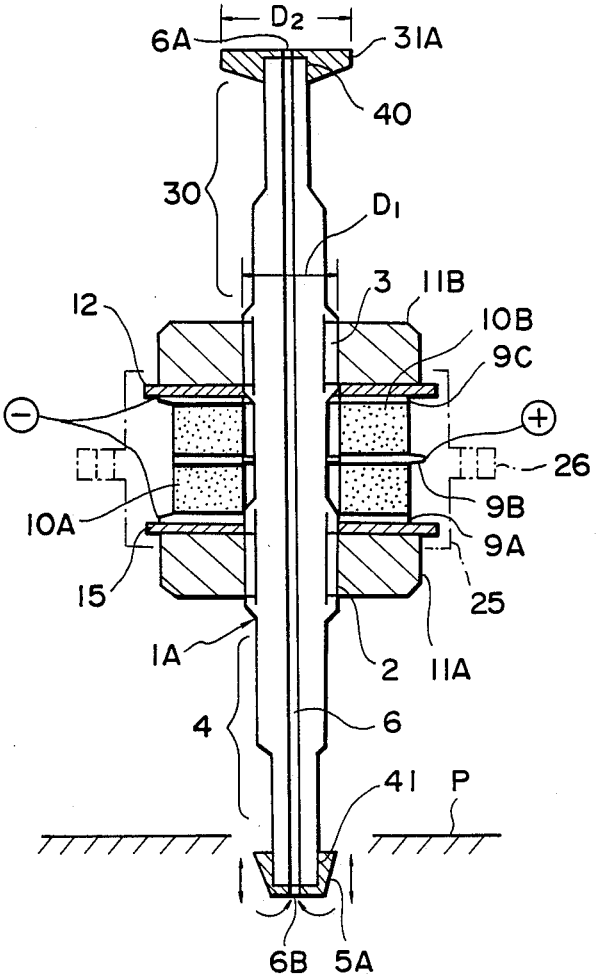
FIG. 5 shows still another structure of the embodiment of a nebulizer according to the present invention.

The larger diameter $D_2$ of the top cap 31A than the diameter $D_2$ of the main body is the important feature of the modification of FIG. 5. The water which is subject to be converted to mist is first placed at the top surface of the top cap 31A, then, due to the violent vibration of the top cap, the water on the top surface is converted to mist. Therefore, it is preferable that the top surface has some area, which is wider than the area defined by the diameter $D_1$ of the main body 1A. The large top surface of the top cap 31A has the advantages that the amount of mist is increased, and the mist has similar size, since water touches first the top surface of the top cap, and then, is converted to mist.

Figure 7:
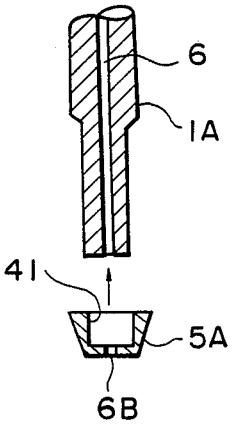
FIG. 7 shows the structure of the bottom portion of a main body 1 in FIG. 5.

Similarly, the bottom cap 5A is provided at the bottom of the main body 1A. FIG. 7 shows the detailed structure of the bottom cap 5A. The bottom cap 5A is essentially cylindrical, having a cylindrical recess 41, which engages with the bottom of the main body 1A, and the hole 6B at the center of the cap 5A so that said hole 6B is positioned at the extension of the hole 6 of the main body 1A. Preferably, the bottom cap is removably attached to the main body 1A, by using, for instance, screws.

The removable bottom cap 5A has the advantage that it can be changed by a fresh bottom cap, when the bottom cap is corroded. In our experience, a bottom portion of the structure is corroded in a short time, due to violent vibration in water.

The water proof structure of FIG. 5 may be either that of FIG. 2, FIG. 3 or FIG. 4.

It should be appreciated that the size and the shape of the bottom cap may be designed independent from those of the bottom portion of the main body.

Figure 8:
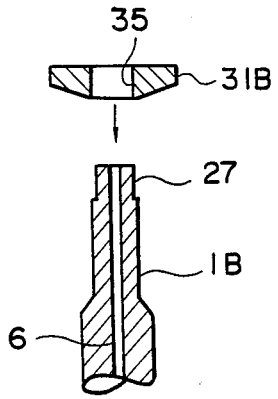
FIG. 8 is a modification of FIG. 6.
Figure 9:
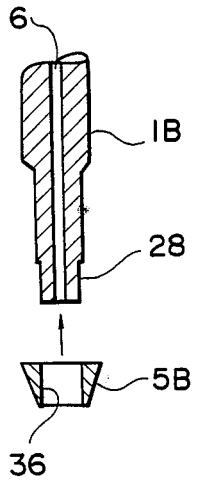
FIG. 9 is a modification of FIG. 7.

FIGS. 8 and 9 show the modification of a top cap, and a bottom cap, respectively. In those figures, the main body lB has a step 27, and a step 28, at the top and the bottom, respectively, as shown in the figures so that those steps 27 and 28 engage with the holes 35 and 36, respectively, of the top cap and the bottom cap, respectively. Therefore, no means corresponding a hole 6A and a hole 6B, of FIGS. 6 and 7, respectively, is provided. Those caps 31B and 5B are fixed to the main body 1B by using screws, or pressure tight.

Some modifications of the present invention are necessary for an actual pump or a nebulizer. Two of them are the attachment of a hard film on an inlet portion of a main body, and the use of a slanted bottom water tank as shown in FIG. 2.

A main body 1, and/or an inlet 5, 5A, 5B is made of stainless steel, which has Vickers hardness around 180–200. However, in our experience, that Vickers hardness is not enough, and the surface of an inlet portion of a main body is corroded in a short time by the cavitation effect of ultrasonic wave energy. In order to prevent the cavitation corrosion, the attachment of a hard film on the surface of an inlet portion of a pump is effective. That hard- film may be titanium nitrate (TiN), or titanium carbide (Tic). The film may be attached on an inlet portion through (1) ion plating process, (2) chemical nitriding process ($Cr_1$ in stainless steel of an inlet is combined with nitrogen (N)). Alternatively, an inlet is quenched after no electrolytic Ni (nickel) plating, or that inlet is coated with ceramics. The Vickers hardness of an inlet is increased to more than 500–600 by one of those processes. Then, the corrosion of an inlet by the cavitation of ultrasonic wave energy is prevented, and the life time of a pump is considerably improved.

In our experiment, the life time of an inlet with no hard film is less than 500 hours when an inlet is made of conventional SUS 304 stainless steel, while the life time reaches longer than, 2000 hours when the surface of that inlet is coated with TiN through an ion plating process.

Another preferable modification is the use of a water tank with a slanted bottom. In our experience, the standing wave of ultrasonic wave appears between an inlet of a pump and a bottom of a basin or a water tank. If the standing wave appears, and the least amplitude portion is at the inlet portion of the pump, the efficiency of the pump is considerably reduced. Therefore, the effect of the standing wave must be removed. We found that the use of a water tank with a slanted bottom is effective to reduce the standing wave effect. Because of the slanted bottom, the water depth between an inlet of a pump and the bottom of the tank is not uniform, and therefore, the standing wave ratio is reduced. The preferable slant angle of a bottom is larger than 10 degrees.

If no slanted bottom is used, the impedance of a ceramic vibration elements depends upon water depth between an inlet of a pump and a bottom of a basin, and the impedance has sharp peak value at some water depths. On the other hand, when a slanted bottom basin with a slanted angle higher than 10 degrees, the impedance of a ceramic vibrator has no peak value irrespective of water depth.

Next, another modification of the present invention is described in accordance with FIGS. 10 through 15. That modification concerns the matching of the mist capability with the pump capability, and the small uniform size of mist particles.

Figure 10:
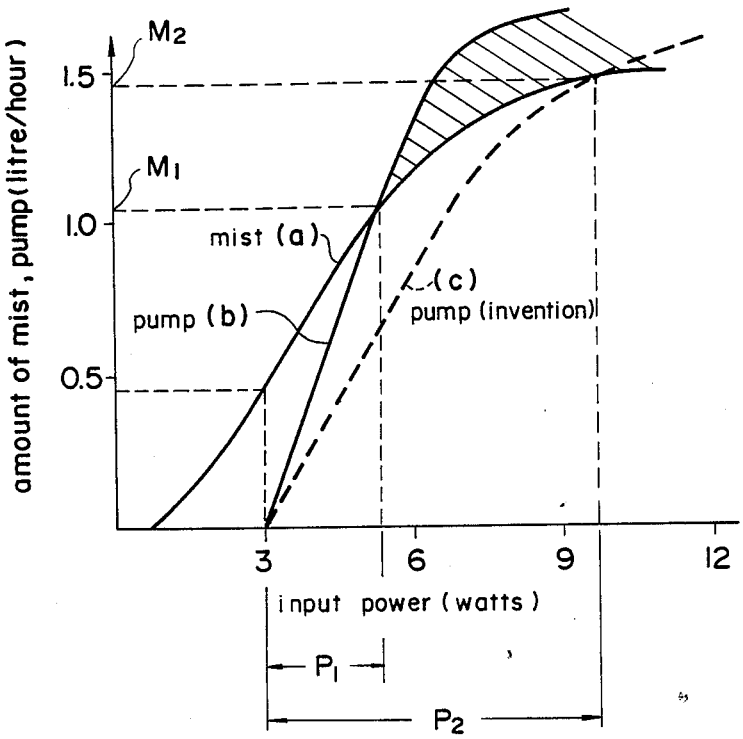
FIG. 10 shows curves between an input power and amount of pumped water and mist.

FIG. 10 shows the curves between the input power of a pump (horizontal axis), and the amount of mist and pumped water (vertical axis). The curve (a) shows the amount of mist, and the curve (b) shows the amount of pumped up water. It should be noted that the gradient of the curve (b) is larger than that of the curve (a).

When the curve (a) resides above the curve (b), in which the input power is in the range of $P_1$, there is no problem, and all water pumped up is misted. However, when an input power is higher than $P_1$, where the curve (b) resides above the curve (a), some ratio of water pumped up is not misted. If the pumped up water is not misted, large particle of water fly or are splashed into air. That is, of course, not prefered.

Figure 11:
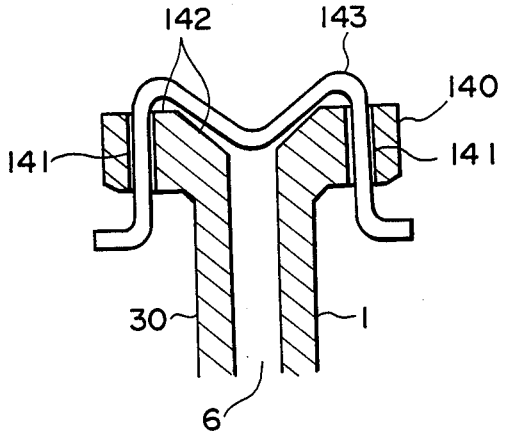
FIG. 11 is a cross section of an outlet in a modification of the present nebulizer.
Figure 12:
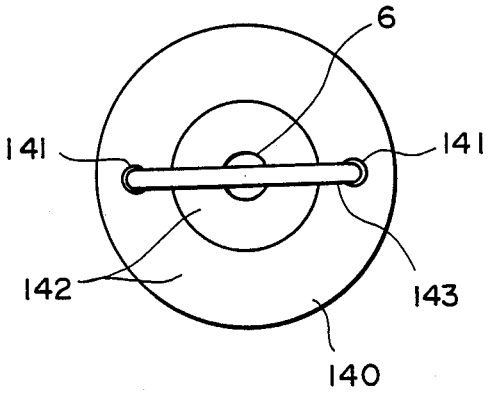
FIG. 12 is a plane view of FIG. 11.

FIGS. 11 and 12 show the first modification for solving that problem. In those figures, the numeral 1 is a main body, 6 is a through hole in the main body 1, and 30 is a vibration amplifying horn. At an outlet portion of the main body 1, there are provided a circular disc 140 which has a pair of through holes 141, and a circular cone shaped recess. An essentially M-shaped bar which is placed along the surface of said cone shaped recess, and a pair of legs of said M-shaped bar are inserted in the through holes 141 of the disc 140 so that the bar 143 may slide along said through holes 141.

The bar 143 is made of for instance copper or stainless steel. Preferably, the ends of the M-shaped bar are bent so that the bar is not removed by the vibration.

In the above structure, the pumped up water is first placed on the top surface 142 of the disc 140. It should be noted in that case that the water does not splash directly into air, because the opening of the hole is covered with the M-shaped bar 143. Since both the disc 140 and the M-shaped bar 143 vibrate violently, the water goes into a gap between the M-shaped bar and the surface of the disc 140, then, the water wets the surface of the disc 140. Then, the water on the top surface of the disc 140 is converted to mist. Preferably, the diameter of the M-shaped bar is equal to or a little smaller than the diameter of the through hole 6.

Figure 13:
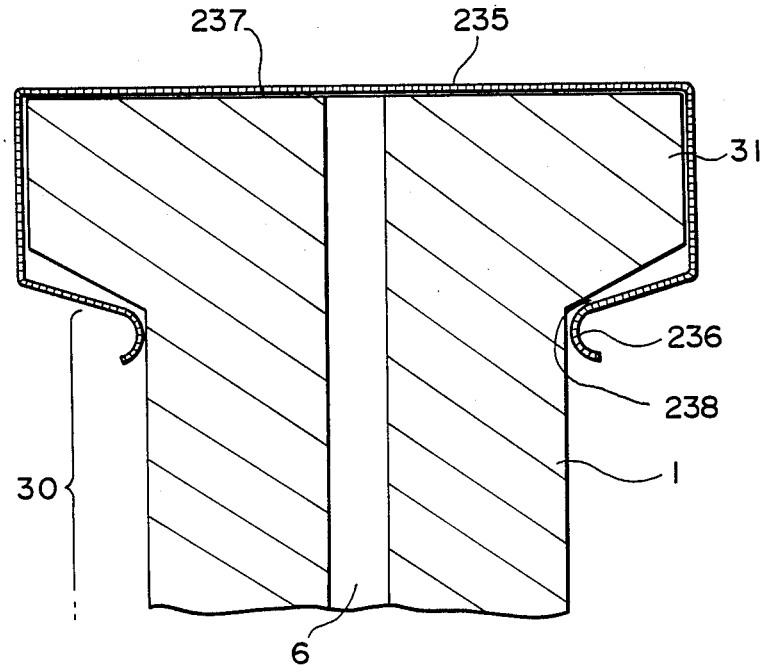
FIG. 13 is the other cross section of an outlet in a modification of the present nebulizer.

FIG. 13 shows the other modification for supplying small size mist. In the figure, the top of the outlet is covered with a mesh 235, which is attached on the outlet so that a thin gap space is provided between the top 237 of the outlet and the mesh 235. Preferably, the mesh is slidable in the direction of an axis of the main body. The end of the mesh 235 is offset towards the thin horn portion 30 of the main body 1. In that case a gap space 238 is also provided between the end of the mesh 235 and the end 236 of the mesh 235 so that the mesh 235 may slide along the axis of the main body 1.

Figure 14:
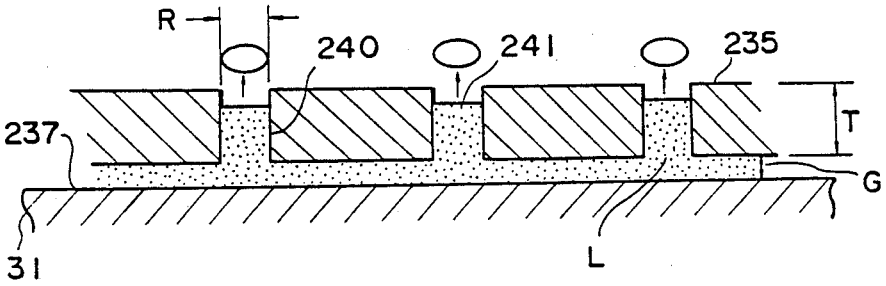
FIG. 14 is an enlarged view of an essential portion of FIG. 13.
Figure 15:
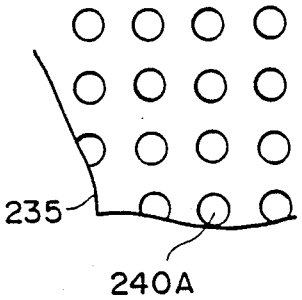
FIG. 15 shows embodiments of the shape of a cell of a mesh in FIG. 13.
Figure 15:
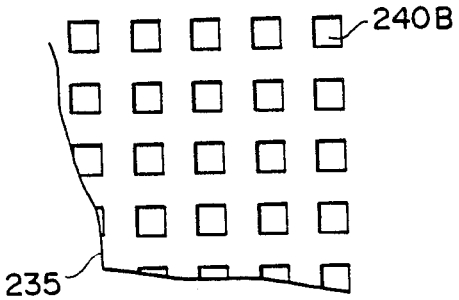

FIG. 14 shows the enlarged view of the mesh 235. Preferably, the diameter R of each hole 240 of the mesh 235 is smaller than the thickness T of the mesh 235, and the total area of the hole 240 is less than 50% of the whole area of the mesh 235, still preferably, that ratio is in the range between 5% and 20%. Preferably, the diameter of a hole 240 is 30 μm, and the thickness T is in the range between 60 μm and 80 μm. The shape of the holes 240 may be circular one 240A as shown in FIG. 15A, or rectangular one 240B as shown in FIG. 15B.

In operation, the pumped up water L (FIG. 14) goes into the thin gap G between the mesh 235 and the outlet 31, and the water spreads into the whole area of the top of the outlet. Then, the water is shaped in a small water column 241 in the holes 240. Due to the violent vibration of the mesh and the outlet, the water column 241 is converted to mist, and is dissipated into the air. The size of the mist particle is defined by the diameter of the hole of the mesh. When the diameter R of the mesh is 30 μm, the diameter of the mist is also around 30 μm.

Since it is preferable that the size of the mist is less than 30 μm, the size of the hole of the mesh is also preferably less than 30 μm. Further, it is preferable that the thickness T of the mesh 235 is larger than 30 μm so that the water column 241 has enough height to be converted to mist.

The structure of FIG. 11 and FIG. 13 has the effect that the size of mist becomes uniform, and the capability of a pump is a little reduced as compared with the case that no mesh nor M-shaped bar is provided. The curve (c) in FIG. 10 shows the pump up capability when a mesh or an M-shaped bar is provided. In case of the curve (c), all the pumped up water is converted to mist when an input power is in the range of $P_2$ which is wider than the range $P_1$. Since the range $P_2$ extends to the higher input power than that of $P_1$, it should be noted that the total amount of mist when a mesh or an M-shaped bar is provided is higher than that when no mesh nor bar is provided. In FIG. 10, the symbol $M_1$ shows the maximum amount of mist when no mesh nor bar is provided, and the symbol $M_2$ shows the maximum mist when a mesh or a bar is provided.

It should be appreciated that each of the modification of FIGS. 11 and 13 can be combined with any of the embodiments of FIGS. 2 though 4, and FIGS. 5 though 9, and of course may have an inlet coated with a thin hard film, and/or a slanted bottom of a water tank.

From the foregoing it will now be apparent that a new and improved ultrasonic wave pump or nebulizer has been found. It should be understood of course that the embodiments disclosed are merely illustrative and are not intended to limit the scope of the invention. Reference should be made to the appended claims, therefore, rather than the specification as indicating the scope of the invention.

What is claimed is:

1. An ultrasonic wave nebulizer for pumping and atomizing water comprising;

an elongated main body having an axis, a center through hole, a water inlet at once end and amist outlet at the other end, said main body having male screw means at an external wall around a central portion of the main body, a plurality of disc shaped vibration elements together with electrodes for energizing the vibration elements, each having a center hole for accepting said main body, so that vibration energy is transmitted in both directions of said main body, nut means with female screw means for fixing said vibration elements together with electrodes on said main body by engaging the female screw means with the male screw means on said main body, a first water proof means fixed to said main body for covering said vibration elements and said electrodes, and having a flange for fixing the nebulizer to an external structure, said flange extending in a plane perpendicular to the axis of the main body and being defined by a center of the vibration elements along the axis, a second water proof means for preventing water to said vibration elements through a passage between said nut means and said main body, said first water proof means being made of resilient plastics covering said vibration elements and said electrodes in non-contacting relation.

2. An ultrasonic wave nebulizer according to claim 1, wherein said first water proof means is a pair of resilient half housings coupled together with each other, and said second water proof means is provided by a ring shaped projection on said main body covered by said first water proof means.

3. An ultrasonic wave nebulizer according to claim 1, wherein said inlet and said outlet are removable from said main body.

4. An ultrasonic wave nebulizer according to claim 1, wherein said inlet and said outlet are fixed to said main body by using screws and are removable.

5. An ultrasonic wave nebulizer according to claim 4, wherein the diameter of said outlet is larger than that of the main body.

6. An ultrasonic wave nebulizer according to claim 1, wherein said inlet is coated with a hard thin layer which has a Vickers hardness higher than 500.

7. An ultrasonic wave nebulizer according to claim 1, wherein said nebulizer is fixed to a water tank which has a slanted bottom.

8. An ultrasonic wave nebulizer according to claim 1, wherein said outlet is covered with a mesh which is slidable in the axial direction of said main body.

9. An ultrasonic wave nebulizer according to claim 8, wherein the mesh comprises a plurality of cells and wherein the size of each cell of said mesh is about 30 μm, and the height of the mesh is larger than 30 μm.

10. An ultrasonic wave nebulizer according to claim 8, wherein a cell of said mesh has a circular shape.

11. An ultrasonic wave nebulizer according to claim 8, wherein a cell of said mesh has a rectangular shape.

12. An ultrasonic wave nebulizer according to claim 8, wherein a top of an outlet is recessed in a cone shape, and an essentially M-shaped bar is slidably attached on an outlet along a cone shaped surface so that the bar covers an opening of the outlet.

* * * * *